US007590257B1

(12) United States Patent
Blanchard et al.

(10) Patent No.: US 7,590,257 B1
(45) **Date of Patent: *Sep. 15, 2009**

(54) AXIALLY PROPAGATING HORN ARRAY FOR A LOUDSPEAKER

(75) Inventors: Mark A. Blanchard, Lebanon, IN (US); Rogelio Delgado, Jr., Rosston, AR (US)

(73) Assignee: Klipsch, LLC, Indianapolis, IN (US)

( * ) Notice: Subject to any disclaimer, the term of this patent is extended or adjusted under 35 U.S.C. 154(b) by 831 days.

This patent is subject to a terminal disclaimer.

(21) Appl. No.: 11/019,152

(22) Filed: Dec. 22, 2004

(51) Int. Cl.
*H04R 25/00* (2006.01)

(52) U.S. Cl. ..... 381/340; 381/339; 381/342

(58) Field of Classification Search ..... 381/338–344, 381/182, 186; 181/144, 177, 187, 192–195, 181/145, 147, 152, 159
See application file for complete search history.

(56) References Cited

U.S. PATENT DOCUMENTS

| | | | | |
|---|---|---|---|---|
| 4,187,926 | A | 2/1980 | Henricksen et al. | |
| 4,324,313 | A | 4/1982 | Nakagawa | |
| 4,348,549 | A | 9/1982 | Berland | |
| 4,580,655 | A | 4/1986 | Keele, Jr. | |
| 4,629,029 | A | 12/1986 | Gunness | |
| 4,923,031 | A | 5/1990 | Carlson | |
| 5,000,286 | A * | 3/1991 | Crawford et al. | 181/145 |
| 5,526,456 | A * | 6/1996 | Heinz | 381/340 |
| 6,628,796 | B2 * | 9/2003 | Adamson | 381/342 |
| 6,658,128 | B1 | 12/2003 | Yoshioka et al. | |
| 7,275,621 | B1 * | 10/2007 | Delgado, Jr. | 381/340 |
| 2002/0038740 | A1 | 4/2002 | Ureda | |
| 2002/0114482 | A1 | 8/2002 | Adamson | |
| 2003/0132056 | A1 | 7/2003 | Meyer et al. | |
| 2003/0133584 | A1 | 7/2003 | Werner | |
| 2003/0194098 | A1 | 10/2003 | Werner et al. | |
| 2003/0219139 | A1 | 11/2003 | Baird et al. | |
| 2004/0060768 | A1 | 4/2004 | Murphy | |

* cited by examiner

*Primary Examiner*—Huyen D Le
(74) *Attorney, Agent, or Firm*—Matthew R. Schantz; Bingham McHale LLP

(57) ABSTRACT

A speaker system including a first and a second horn, each having a respective acoustic driver and a respective planar mouth and a respective throat operationally connected between the respective acoustic driver and the respective mouth, wherein the mouths are substantially coplanar. The system is characterized by an acoustic dispersion angle of about thirty degrees in a first vertical dispersion plane and by an acoustic dispersion angle of at least about ninety degrees in a second horizontal dispersion plane oriented orthogonally to the first dispersion plane.

16 Claims, 16 Drawing Sheets

AXIALLY PROPAGATING HORN ARRAY FOR A LOUDSPEAKER

TECHNICAL FIELD OF THE INVENTION

The invention relates generally to the field of waveguides, and, more particularly, to a diffuse multiple-horn loudspeaker system

BACKGROUND OF THE INVENTION

With the advent of multi-channel audio technology for movie soundtracks encoded in formats such as DTS, DOLBY DIGITAL®, DVD Audio, DVD-A, Super Audio Compact Disc, SACD, or the like, surround-sound speakers capable of producing wide dispersion output have been in increasingly high demand for both auditorium and home theatre applications. Surround speaker requirements include diffuse dispersion in the horizontal axis to blur the time arrivals to the listener's ear. This concept is referred to as "reverb." The audio source may be music, a sound effect, or the like. Multiple speakers can be grouped together to provide a wide dispersion of sound, but there is a nontrivial likelihood that the interaction between such acoustic sources will be acoustically destructive, degrading the sound quality heard by a listener.

Ideally, a point source solution is the answer to this difficulty, but due to size limitations (i.e., most compression drivers are roughly cylindrical with diameters between about 5 and 8 inches, making close placement difficult) and limitations of power output capabilities, such a design is impractical and unfeasible in most working applications. Accuracy and intelligibility of acoustic signal is a result of the way the loudspeaker reconstructs the temporal and spectral response of the reproduced wave front. Phase coherence of the signal or wave front is a result of the temporal response when reconstructed. A number of difficulties arise when attempting to sum acoustic wavefronts from multiple drivers including standing waves interference and phase cancellation between mutually acoustic sources.

In practice, the surround-sound speaker design has generally been approached by providing a bi- or tri-polar speaker with 180 degrees dispersion in the horizontal axis. The difficulty with this design is that most transducers tend to narrow the dispersion angle as the wavelength of the output increases to beyond the area of the transducer mouth. This effect is referred to as "beaming". The waveguide geometry and/or the throat dimension of the compression driver and/or the diaphragm area of a dome tweeter are the primary contributors to beaming. To avoid beaming, multiple transducers can be used in an arc or array to maximize the dispersion angle in the horizontal axis. Unfortunately, the complication in this approach is that the polar patterns of dispersion tend to overlap or mesh, and thus do not sum acoustically in the axis wherein the transducers are placed due to phase differences. The phase differences give rise to destructive interference, which is interpreted by the listener as a reduction in fidelity and sound quality. Therefore, beaming is reduced at the expense of sound quality from incoherent phase contributions.

Thus, there remains a need for a surround-sound speaker design that can provide surround-sound without both beaming and destructive interference from the horns. The present invention addresses this need.

SUMMARY OF THE INVENTION

The present invention relates to a surround-sound speaker system, including a plurality of waveguides or horns having noncodirectional acoustic emissions. Each speaker system includes an acoustic driver, a mouth, and a throat operationally connected between the acoustic driver and the mouth. The speaker system is characterized by an acoustic dispersion angle of at least about thirty degrees the vertical dispersion plane and at least about sixty degrees, and more typically between about ninety and about one-hundred and eighty degrees in the horizontal dispersion plane.

One object of the present invention is to provide an improved loudspeaker design. Related objects and advantages of the present invention will be apparent from the following description.

DESCRIPTION OF THE PREFERRED EMBODIMENTS

Figure 1A:
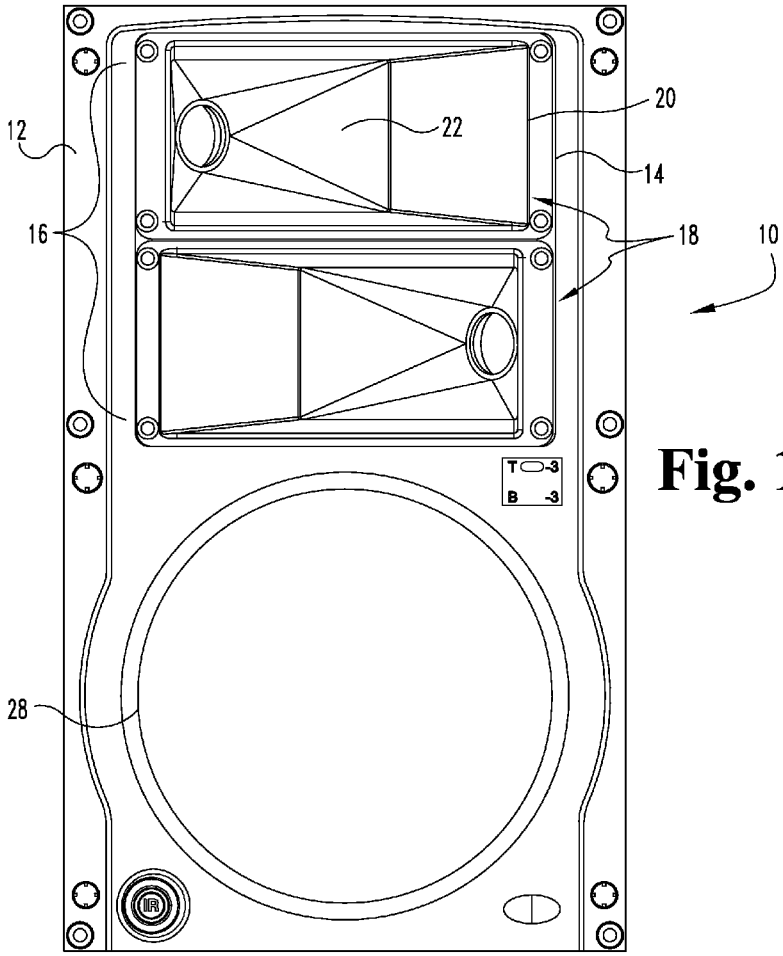
FIG. 1A is a front plan view of a first embodiment speaker system of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Overview

A waveguide or horn loudspeaker may be thought of as an electro-acoustic transducer that translates an electrical signal into a directed acoustic signal. As used herein, "waveguide" means a conical or expanding duct or channel designed to confine and direct the propagation of modulated air pressure (i.e., acoustic waves) in a longitudinal direction. A waveguide typically consists of a coupling flange at its acoustical entrance for connecting a compression driver transducer thereto. The waveguide also typically includes a mouth defining an expanding waveguide or duct that exits to the ambient air and a mounting flange to affix the waveguide to a baffle board or other such enclosure, which may be an elaborate framework device or nothing more than a recess or cavity formed in a wall. A throat, such as the narrowmost area of a mouth cone or mouth duct with expanding walls or surfaces, extends between the mouth and the acoustical entrance.

Generally, a compression driver is operationally connected via a throat to the mouth of the horn to achieve proper acoustic impedance, high efficiency, low distortion and controlled dispersion. Horn speakers sound very dynamic and reproduce fast transients in the music due to their relatively low moving mass. For applications with dispersion of 100 degrees or less, a single horn using a single driver is usually adequate. For applications requiring wider dispersion angles at higher frequencies, additional horns and drivers are required.

The present invention relates to high frequency acoustic sources arranged in an array. The array or horn assembly can be defined by a plurality of horns, each characterized by at least about 30 degrees and more typically 60 degrees or more of dispersion. The coupling flange of each horn allows for mounting thereonto of a transducer with a "bolt on", "screw on" or like mounting configuration. Multiple transducers are attached to the horn assembly and signal is applied in parallel to each transducer. The application of signal to the transducer results in the transduction of (typically electrical) signal energy into modulated air pressure or sound waves. In the case of compression drivers, this occurs through oscillation of the voice coil in a magnetic gap. Once produced, the longitudinal sound waves travel down the throat of the horn, following the area of expansion. This process happens simultaneously down the plurality of throats in the horn assembly. The path lengths down each throat are typically substantially identical so as to maintain phase angle between sound sources (i.e., transducers). The mouths or exit areas of each horn throat are positioned substantially adjacent to one another, so as to minimize the distance between mouth edges. This configuration gives rise to the maximization of the summation of acoustic output.

Constructive propagation may occur when two or more sound sources of the same frequency propagate in the same space. When the wavelength propagation is generally in phase and the same size as, or larger than, the spacing between the sound sources, the sources tend to reinforce one another. This phenomenon is known as mutual coupling. Mutual coupling has similar acoustic characteristics in a given bandwidth of frequency as a point source (i.e., sound emanating from one location) and is desirable.

Figure 1C:
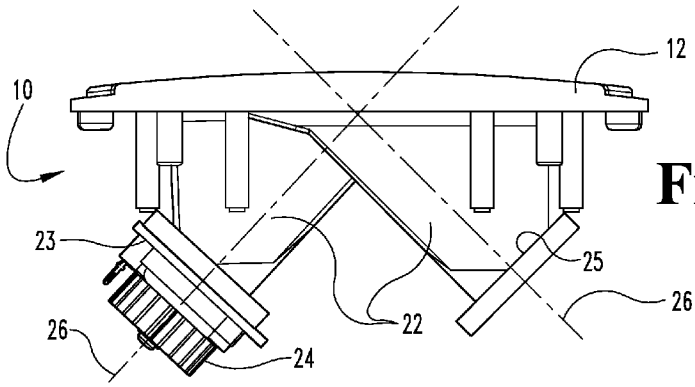
FIG. 1C is a top plan view of FIG. 1A.
Figure 1B:
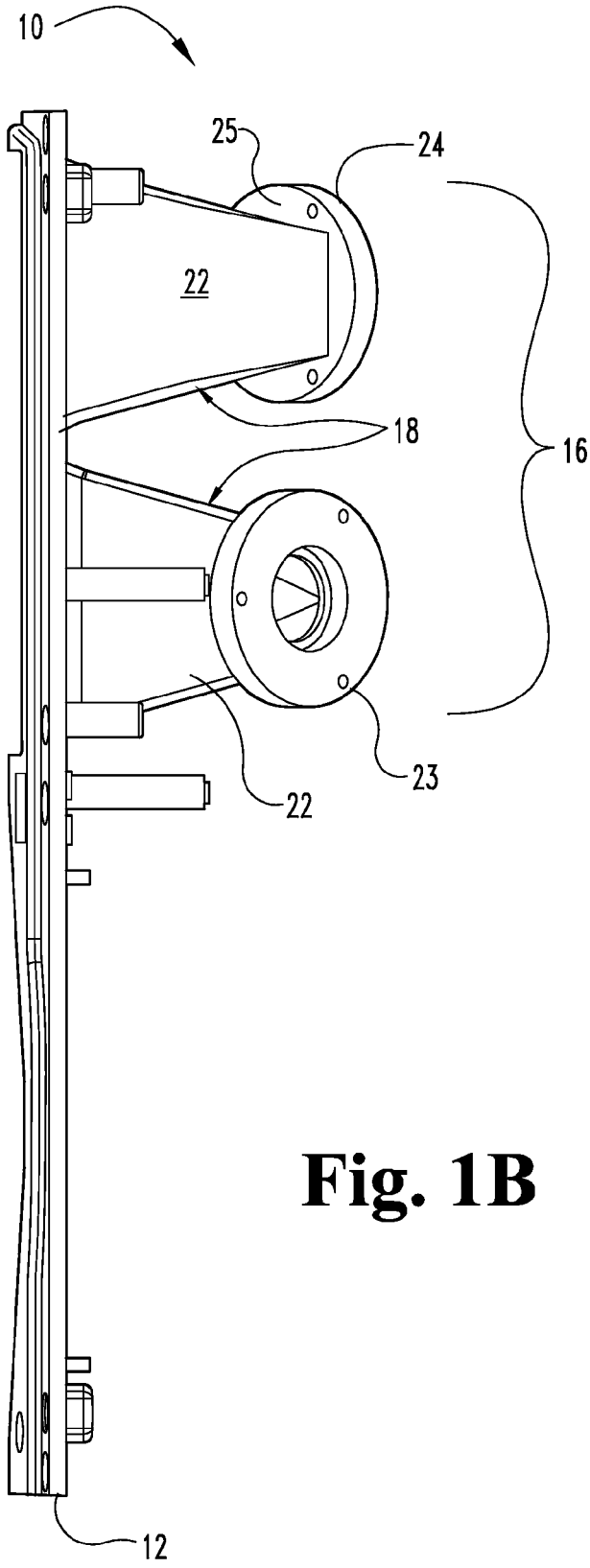
FIG. 1B is a side plan view of the embodiment of FIG. 1A.
Figure 2A:
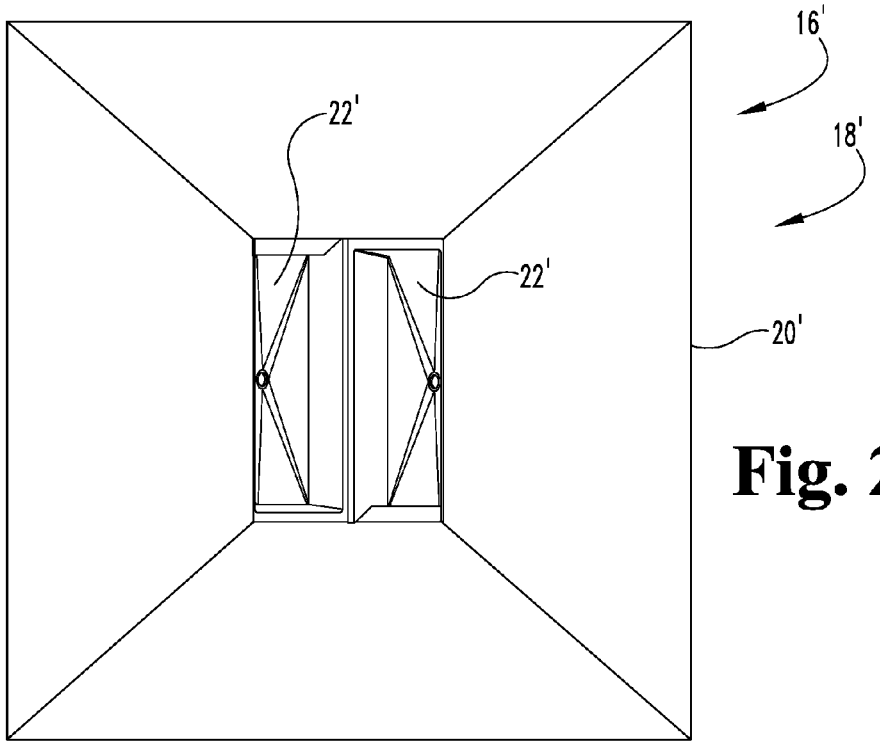
FIG. 2A is a front plan view of a second embodiment horn assembly of the present invention.
Figure 2B:
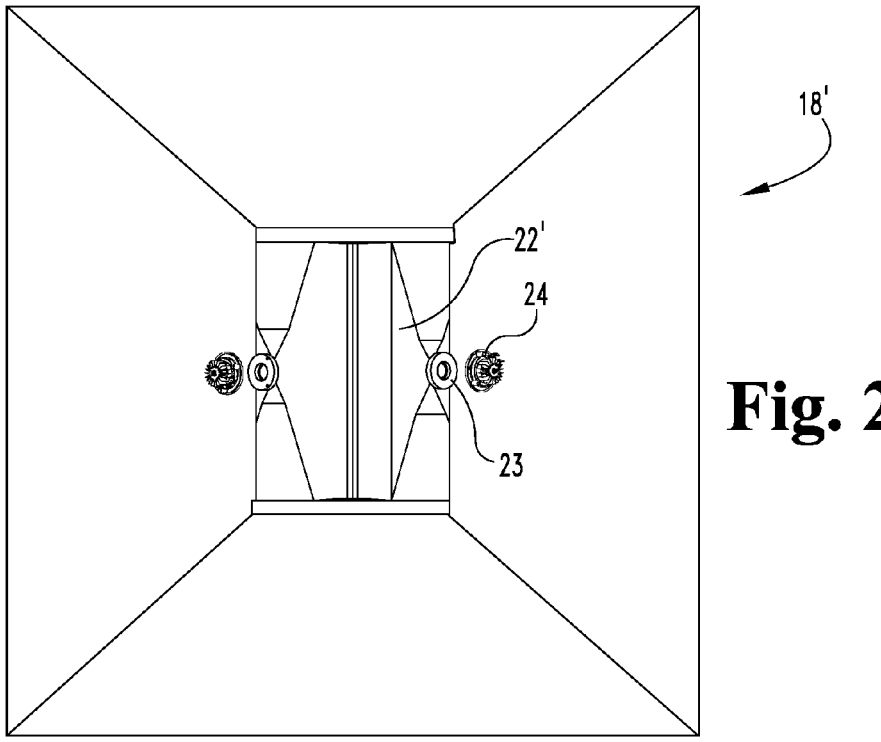
FIG. 2B is a rear plan view of the horn assembly of FIG. 2A.
Figure 2C:
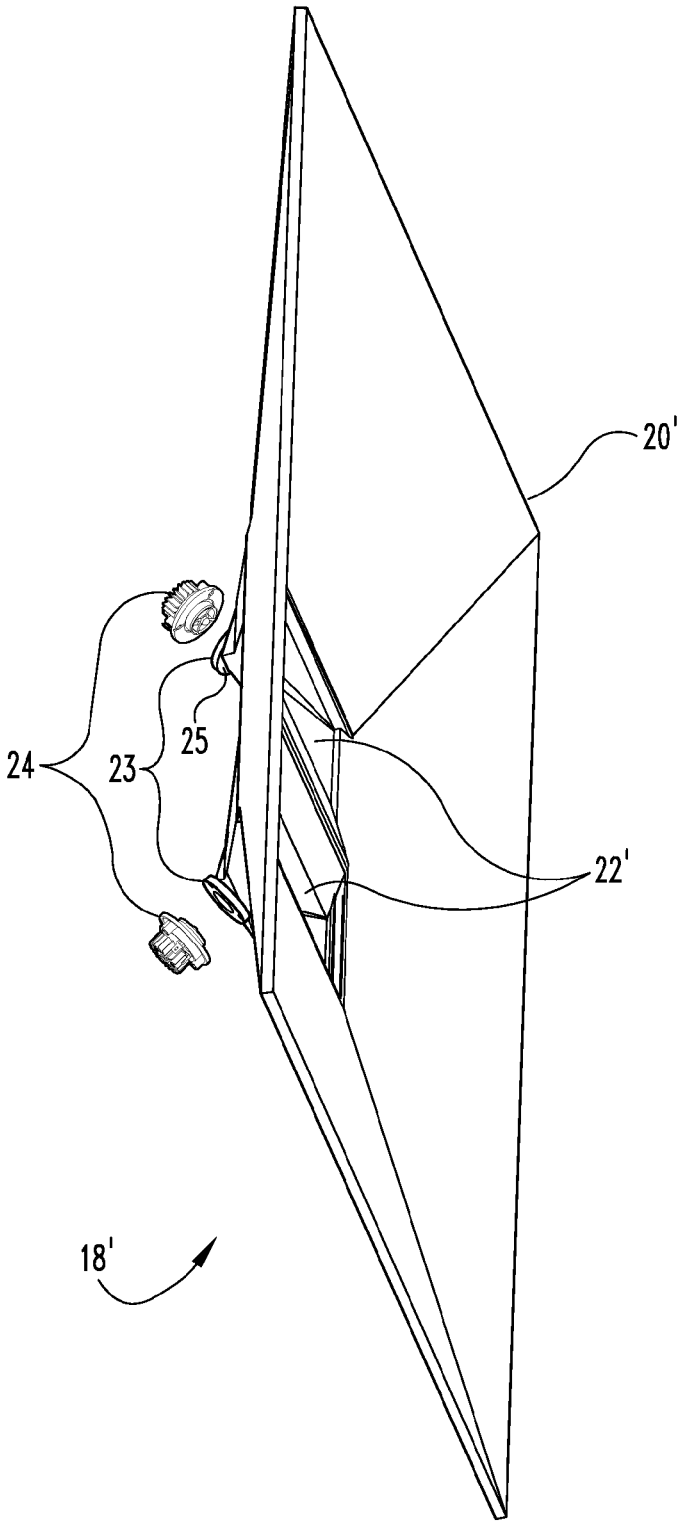
FIG. 2C is a perspective elevation view of FIG. 2A.
Figure 2D:
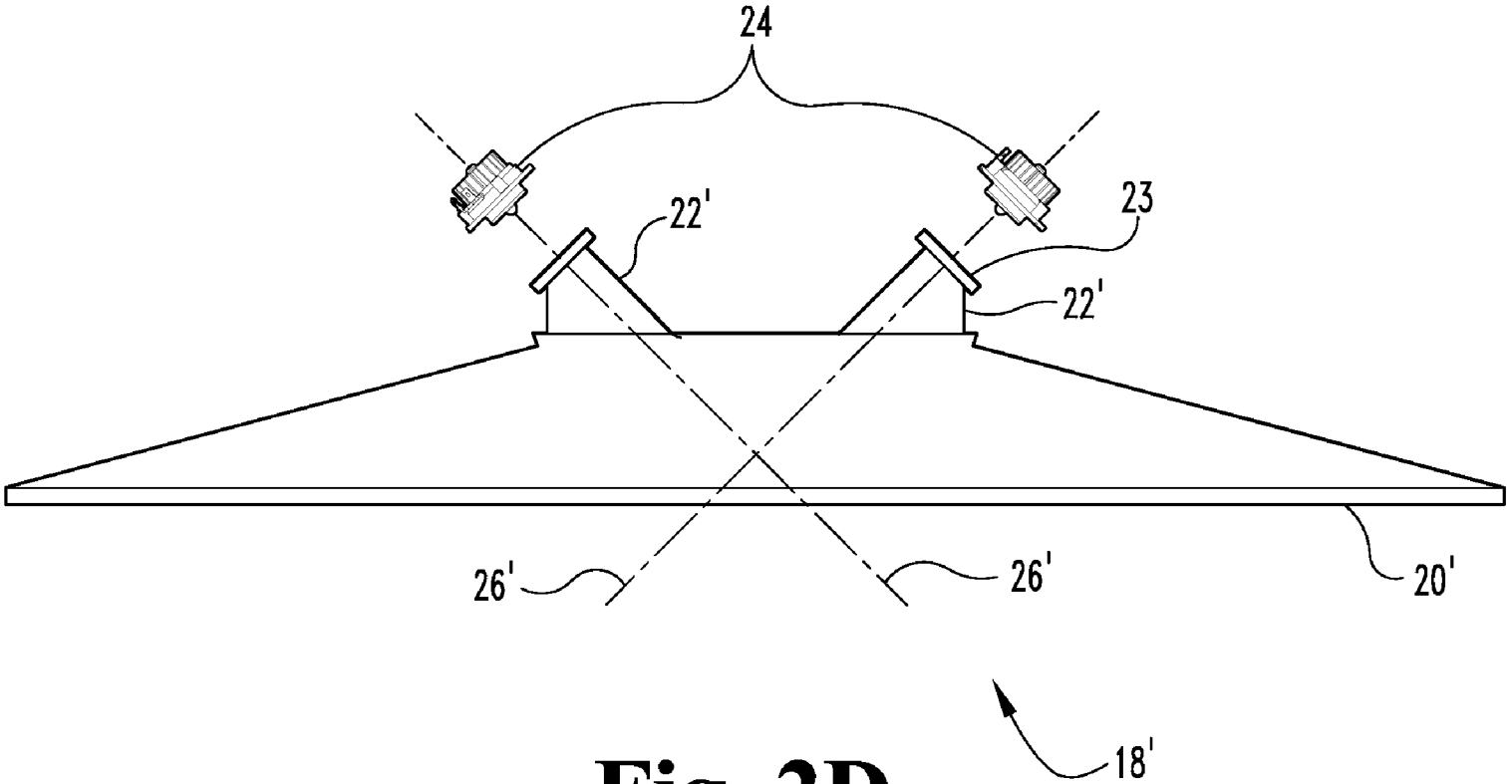
FIG. 2D is a top plan view of FIG. 2A.

FIGS. 1A-1C illustrate a first embodiment of the present invention, a speaker system 10 including a substantially flat frame or baffle board portion 12 having a horn assembly aperture 14 for supporting a horn assembly 16. The horn assembly 16 typically includes a pair of waveguides or horns 18. Each horn 18 further includes a mouth 20, a throat 22 and a driver or transducer 24. The throat 22 is essentially a hollow tube positioned between and acoustically connecting the mouth 20 and the driver 24 via the coupling flange 23. Typically the driver 24 may be thought of as defining a substantially flat output plane 25 oriented parallel with the plane defined by the contact surface of the coupling flange 23. The throat 22 is further characterized by a central axis 26 extending therethrough, which is also typically normal to the output plane 25. It is convenient to note that the central axis 26 also defines the primary direction of acoustic output of the horn 18, and that the central axes 26 of the horns 18 are typically not oriented in parallel with each other. In other words, the horn array 16 includes at least two horns 18 having throats 22 defining nonparallel axes 26. Typically, the array 16 includes two horns 18 defining two nonparallel axes 26; more typically, the axes 26 are oriented at an angle of at least about 60 degrees relative each other; still more typically, the axes 26 are oriented at an angle of about 90 degrees relative to each other. When three horns 18 are arrayed, the outer horns 18 are typically oriented symmetrically about the middle horn, and more typically, each outer horn 18 is oriented at an angle of about 45 degrees with the middle horn 18.

Typically, the frame 12 will include one or more additional apertures 28 for supporting additional speaker units, such as one or more woofers, midrange transducers, or the like. Various frame 12 configurations are illustrated in FIGS. 3A-4C, and are discussed in greater detail below.

FIGS. 2A-2D illustrate a second embodiment horn array 16' operative in the speaker system 10 described above. The horn array 16' is similar in most respects to the horn array 16 of FIGS. 1A-1C above, with the primary difference being that the horn array 16' is effectively a single horn 18' including a plurality of throats 22', each respective throat 22' acoustically connected between a respective individual driver 24 and the mouth 20'. The throats 22' are each characterized by a respective central axis 26', and the central axes 26' of the throats 22' are typically nonparallel with each other. As above, each driver 24 typically includes a substantially flat output plane 25 that is also typically normal to the axis 26' associated with the respective acoustically connected throat 22'. Each horn array 16' thus effectively produces acoustic output defining at least two distinct directions that effectively combine to generate a diffuse, wide-angle acoustic output. Typically, each throat 22' defines two axes 26'; more typically, the axes 26' are oriented at an angle of at least about 60 degrees relative to each other; still more typically, the axes 26' are oriented at an angle of about 90 degrees relative to each other.

Figure 3B:
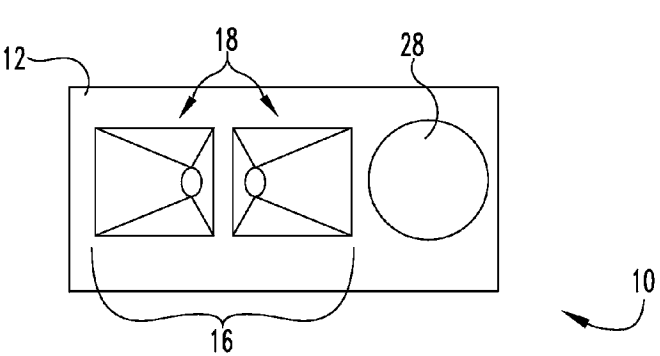
FIG. 3B is a front schematic view of a first embodiment speaker system having a second configuration.
Figure 3D:
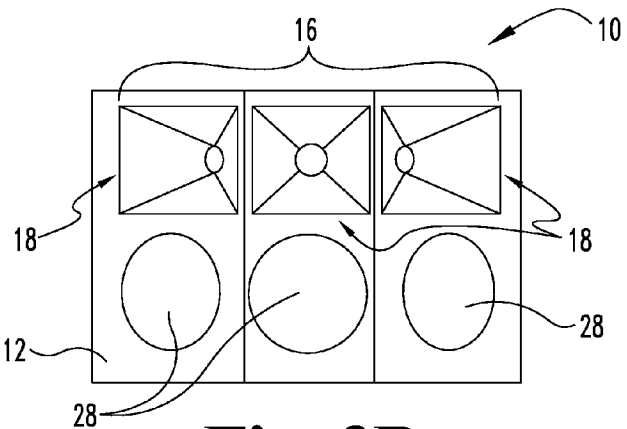
FIG. 3D is a front schematic view of a first embodiment speaker system having a fourth configuration.
Figure 3A:
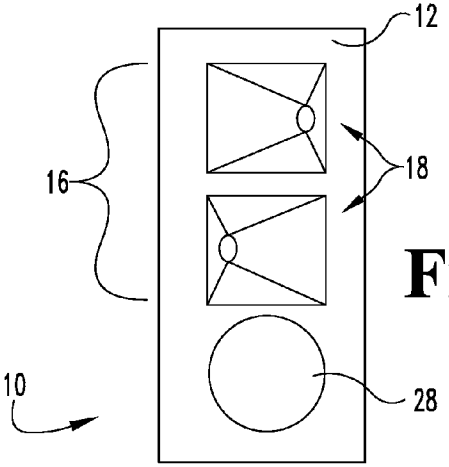
FIG. 3A is a front schematic view of a first embodiment speaker system having a first configuration.

FIGS. 3A-3D illustrate four different configurations of the system 10 described above in FIGS. 1A-1C. The configurations are intended to be illustrative of some of the different possible configurations of the speaker system 10, and accordingly are not intended to illustrate all possible configurations. FIG. 3A illustrates a speaker system 10 including a generally rectangular frame 12 including one or more horn assembly aperture(s) 14 and a (typically generally circular) speaker aperture 28. The horn array 16 is typically oriented such that a first horn 18 is positioned between a second horn 18 and the speaker aperture 28 (which is configured to receive a woofer, a low frequency transducer, midrange transducer, or the like). The frame 12 is configured to be mounted or positioned such that the longer dimension is oriented substantially vertically, such that the first horn 18 is positioned atop the second horn 18, and the axes 26 intersect in a nonzero angle when projected into a substantially horizontal plane. In other words, when the frame 12 is oriented as specified above, the horn assembly 16 produces diffuse, wide-angle output in a substantially horizontal plane.

The speaker system illustrated in FIG. 3B includes a generally rectangular frame 12 including one or more horn assembly aperture(s) 14 and a (typically generally circular) speaker aperture 28. The horn array 16 is typically oriented such that a first horn 18 is positioned between a second horn 18 and the speaker aperture 28 (which is configured to receive a woofer, a low frequency driver, a midrange transducer, or the like). The frame 12 is configured to be mounted or positioned such that the longer dimension is oriented substantially horizontally, such that the first horn 18 is positioned beside the second horn 18, and the axes 26 intersect in a nonzero angle when projected into a substantially horizontal plane. In other words, when the frame 12 is oriented as specified above, the horn assembly 16 produces diffuse, wide-angle output in a substantially horizontal plane.

Figure 3C:
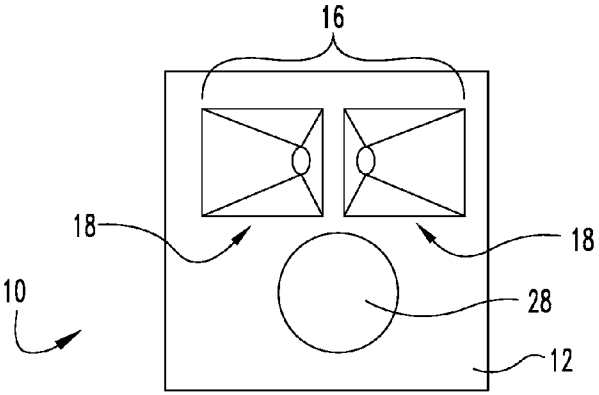
FIG. 3C is a front schematic view of a first embodiment speaker system having a third configuration.

The speaker system 10 shown in FIG. 3C includes a generally rectangular or square frame 12 including one or more horn assembly aperture(s) 14 and a (typically generally circular) speaker aperture 28. The horn array 16 is typically oriented such that a first horn 18 is positioned beside or horizontally adjacent a second horn 18 and the speaker aperture 28 (which is configured to receive a woofer, a low frequency driver, a midrange transducer, or the like) is centered below the horn assembly 16 (i.e., below the first and second horns 18). The frame 12 is configured to be mounted or positioned such that the first horn 18 is positioned beside the second horn 18 and over the speaker aperture 28, and the axes 26 intersect in a nonzero angle when projected into a substantially horizontal plane. In other words, when the frame 12 is oriented as specified above, the horn assembly 16 produces diffuse, wide-angle output in a substantially horizontal plane.

FIG. 3D relates to a speaker system 10 that includes a generally rectangular frame 12 including one or more horn assembly aperture(s) 14 and a plurality of (typically generally circular) speaker apertures 28. The horn array 16 is typically oriented such that a first horn 18 is positioned horizontally adjacent and between a second horn 18 and a third horn 18. A row of speaker apertures 28 (which is configured to receive a woofer, a low frequency driver, a midrange transducer, or the like) positioned below the horn assembly 16 and is typically centered relative the horn assembly 16. The frame 12 is configured to be mounted or positioned such that the horn assembly extends in a horizontally oriented row with any two axes 26 intersecting in a nonzero angle when projected into a substantially horizontal plane. In other words, when the frame 12 is oriented as specified above, the horn assembly 16 produces diffuse, wide-angle output in a substantially horizontal plane.

Figure 4A:
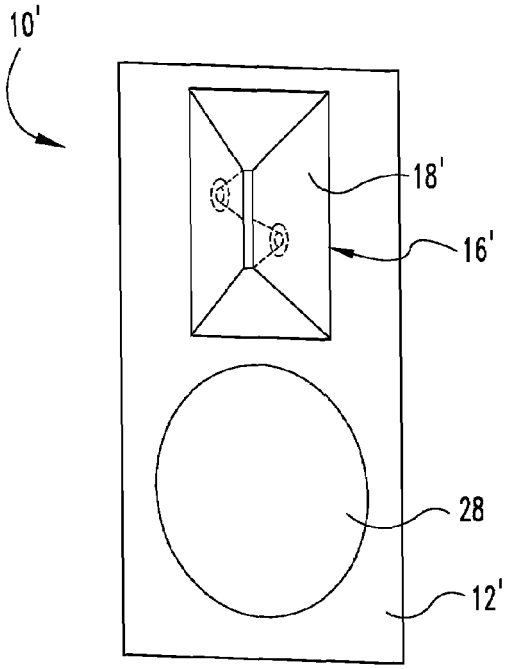
FIG. 4A is a front schematic view of a second embodiment speaker system having a first configuration.
Figure 4B:
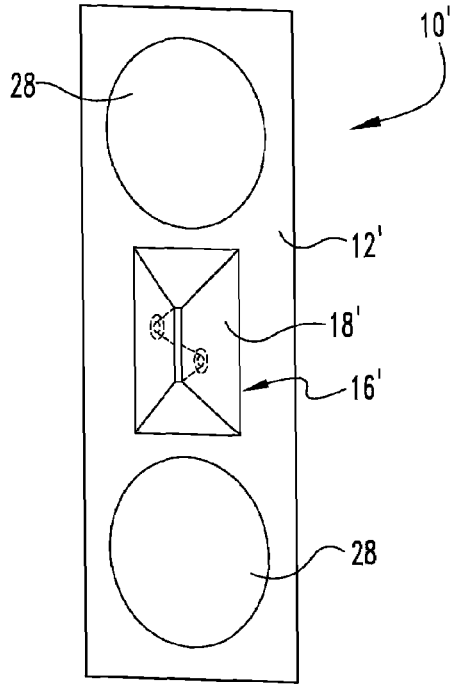
FIG. 4B is a front schematic view of a second embodiment speaker system having a second configuration.
Figure 4C:
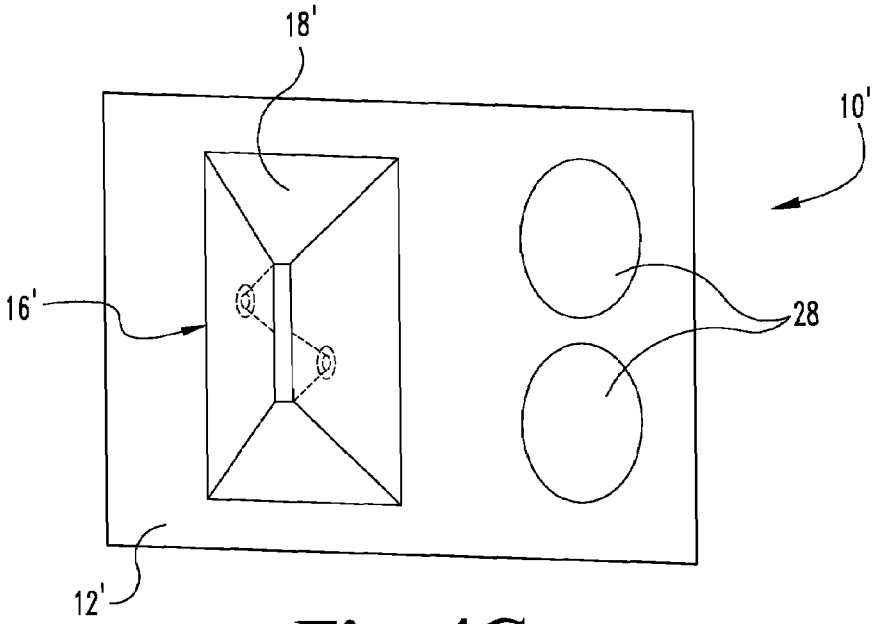
FIG. 4C is a front schematic view of a second embodiment speaker system having a third configuration.

FIGS. 4A-4C illustrate three typical configurations of the system 10' described above and includes using the horn array 16' of FIGS. 2A-2D. Again, the configurations are intended to be illustrative of different possible configurations of the speaker system 10', and are not intended to illustrate all possible configurations or numbers of waveguides 18' and/or transducers 24'. FIG. 4A shows a system 10' with a generally rectangular frame 12' and including a horn assembly 16' and a (typically generally circular) speaker aperture 28. The horn assembly 16' includes a horn 18' positioned above the speaker aperture 28 (which is configured to receive a woofer, a subwoofer, or the like). The horn assembly 16' includes at least two throats 22' and drivers 24'. The frame 12' is configured to be mounted or positioned such that the longer dimension is oriented substantially vertically, such that the horn 18' is positioned atop the aperture 28 and the axes 26 intersect in a nonzero angle when projected into a substantially horizontal plane. In other words, when the frame 12' is oriented as specified above, the horn assembly 16' produces diffuse, wide-angle output in a substantially horizontal plane.

The speaker system 10' configuration shown in FIG. 4B is similar to that shown in FIG. 4A, but with the addition of an additional speaker aperture 28 in the rectangular frame 12. The horn assembly 16' is positioned between the two apertures 28 such that when the frame 12' is positioned such that the longer frame dimension is oriented substantially vertically, the horn 18' is positioned atop the aperture 28 and the axes 26 intersect in a nonzero angle when projected into a substantially horizontal plane. In other words, when the frame 12 is oriented as specified above, the horn assembly 16' produces diffuse, wide-angle output in a substantially horizontal plane.

In FIG. 4C, the frame 12' includes horn assembly 16' positioned beside a pair of vertically positioned speaker apertures 28. When oriented as shown, the horn 18' produces diffuse, wide-angle output in a substantially horizontal plane.

Figure 5A:
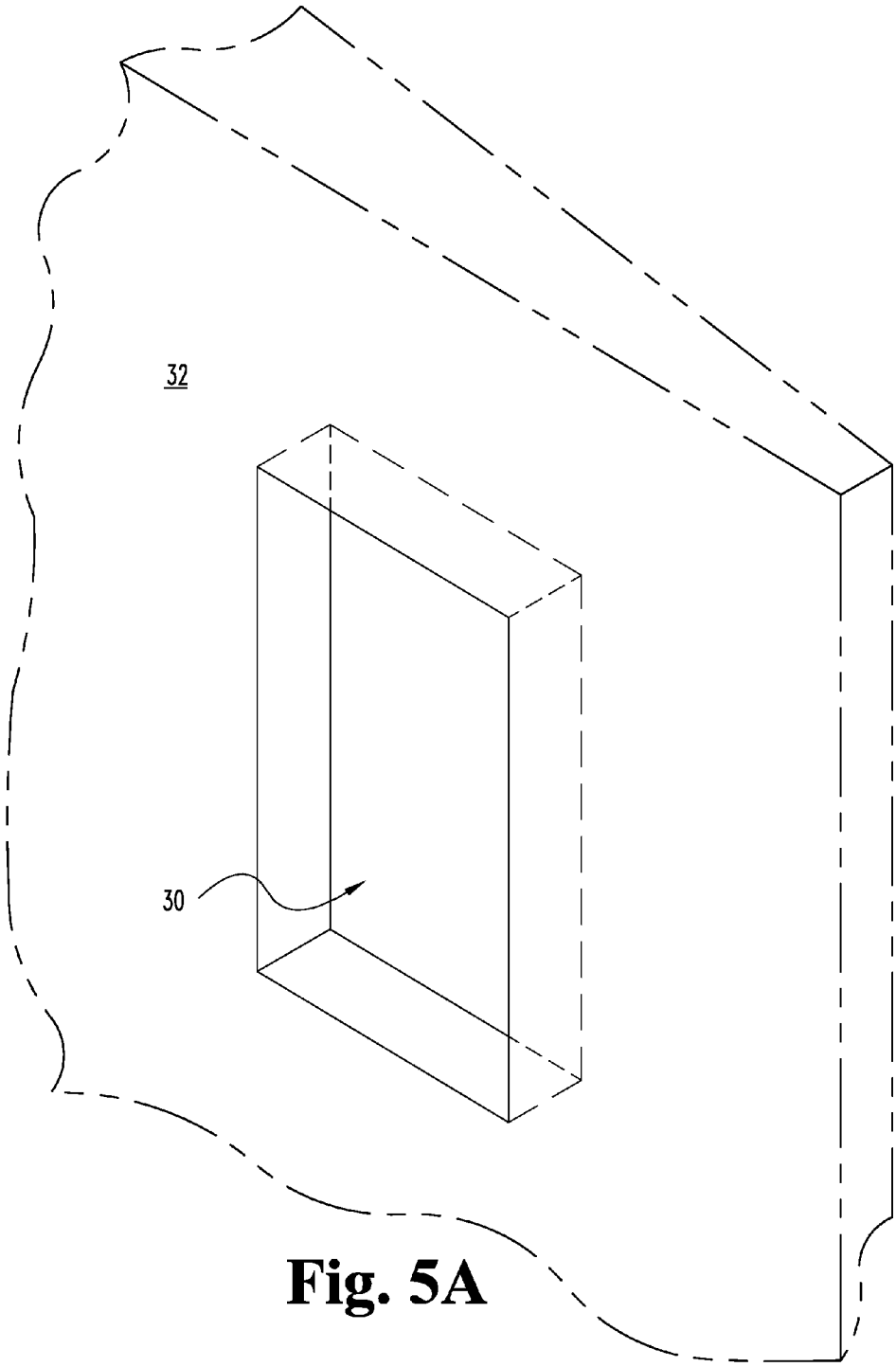
FIG. 5A is a perspective schematic view of a wall having a cavity for receiving a speaker system according to an embodiment of the present invention.
Figure 5B:
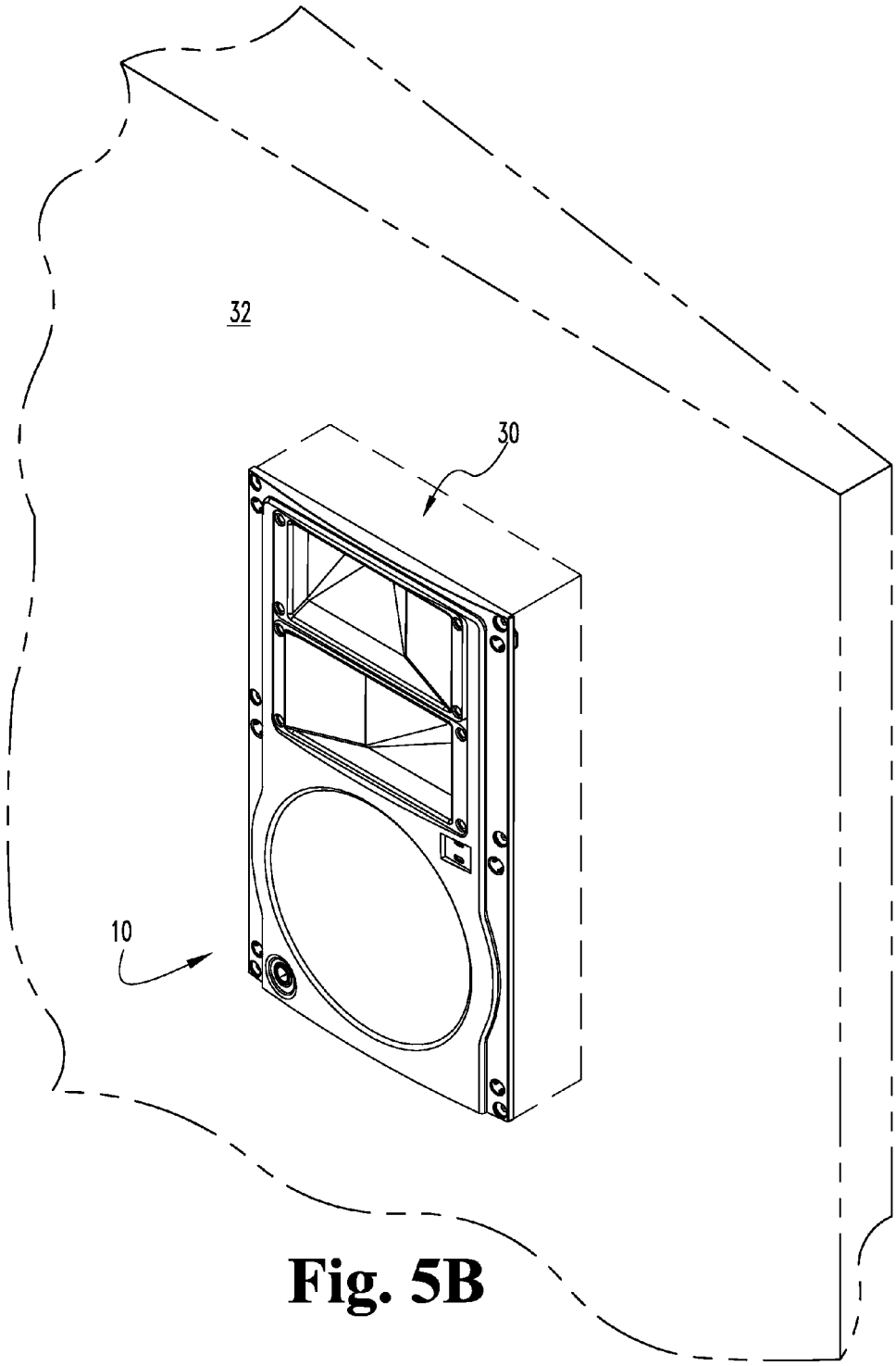
FIG. 5B is a perspective view of FIG. 5A including a speaker system received in the cavity.
Figure 5C:
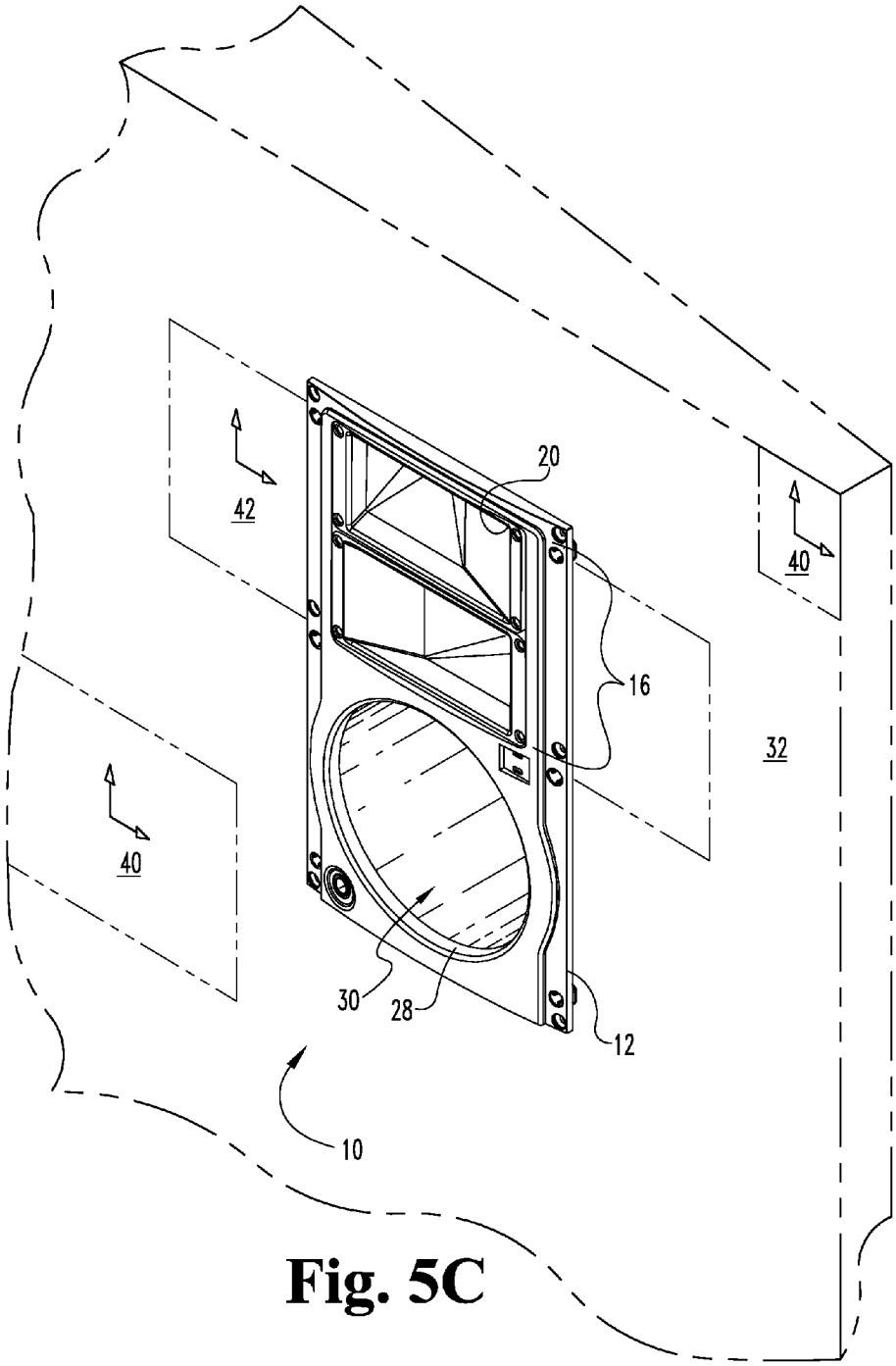
FIG. 5C is an enlarged view of FIG. 5C showing the speaker system in more detail.
Figure 6A:
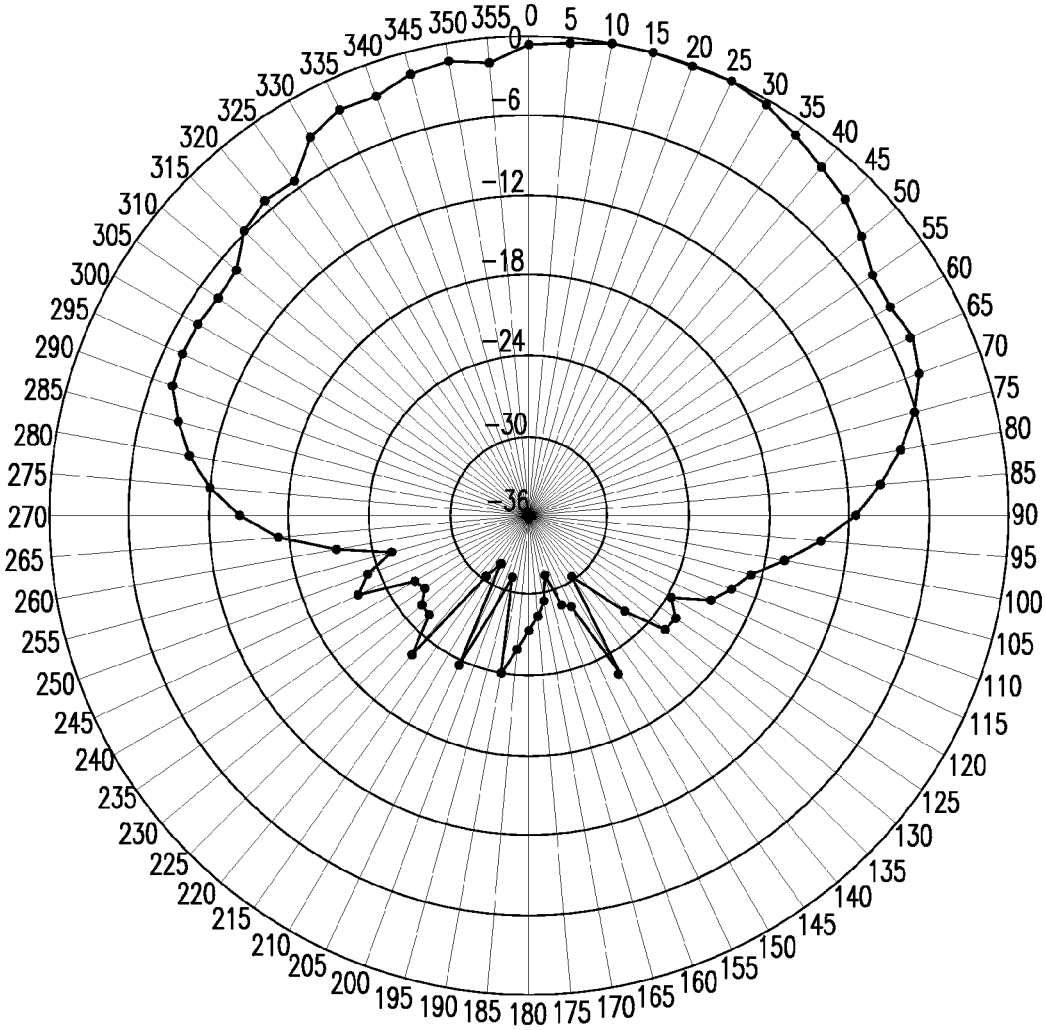
FIG. 6A is a graphic representation of experimentally measured horizontal polar response curves at a frequency of 5 kiloHertz for a first embodiment speaker system of the present invention.
Figure 6B:
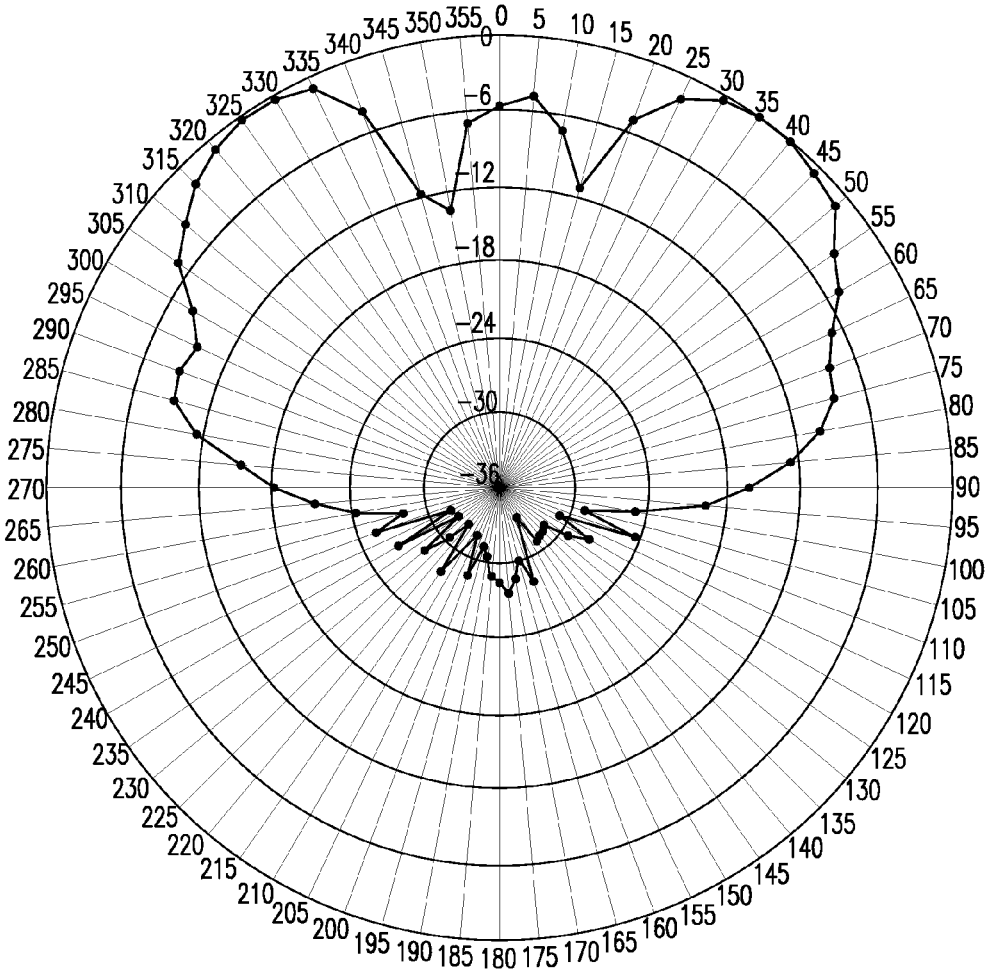
FIG. 6B is a graphic representation of experimentally measured horizontal polar response curves at a frequency of around 10 kiloHertz for a first embodiment speaker system of the present invention.
Figure 6C:
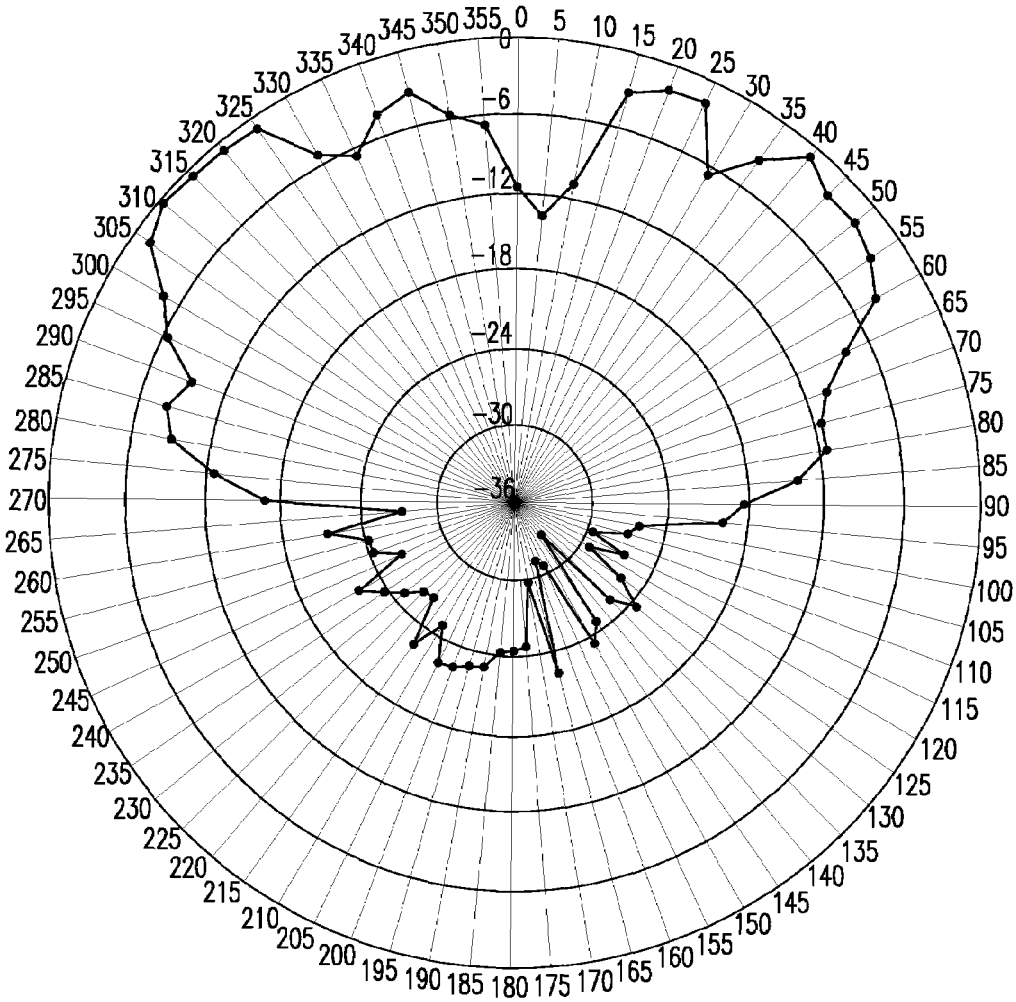
FIG. 6C is a graphic representation of experimentally measured horizontal polar response curves at a frequency of around 18 kiloHertz for a first embodiment speaker system of the present invention.
Figure 6D:
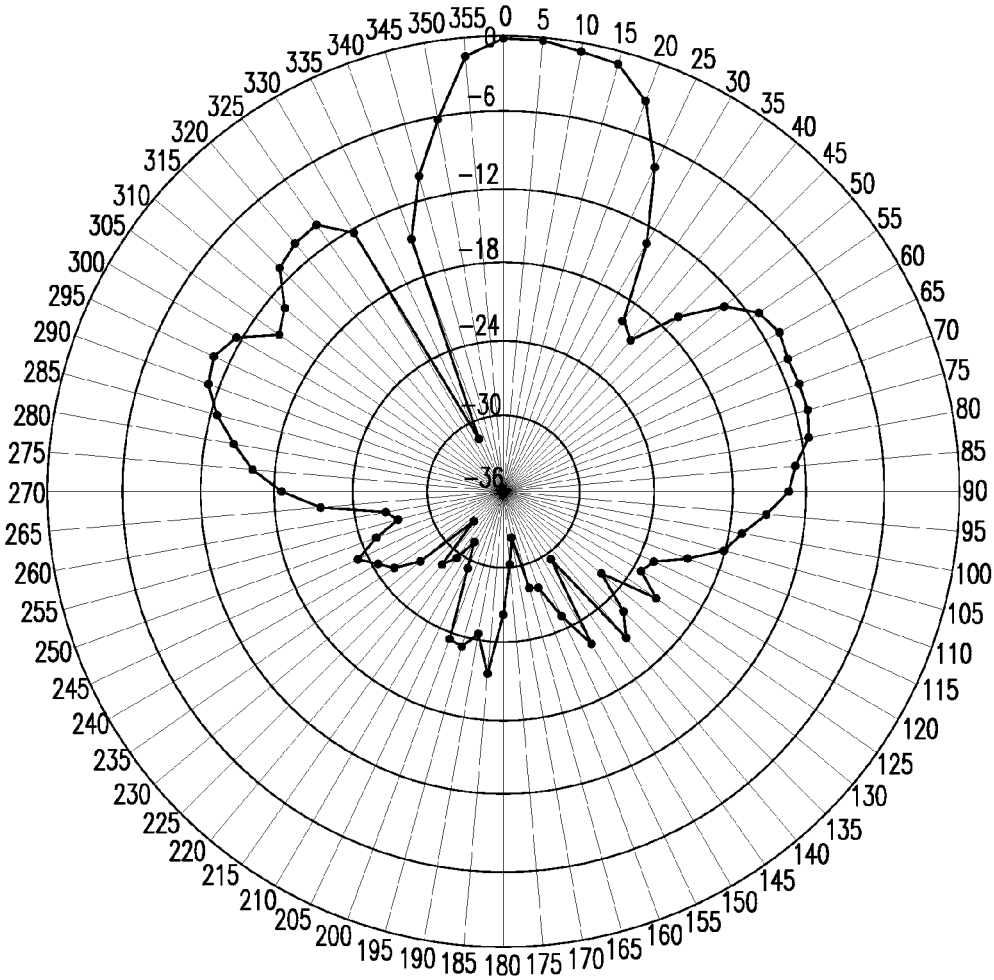
FIG. 6D is a graphic representation of experimentally measured vertical polar response curves at a frequency of around 5 kiloHertz for a first embodiment speaker system of the present invention.
Figure 6E:
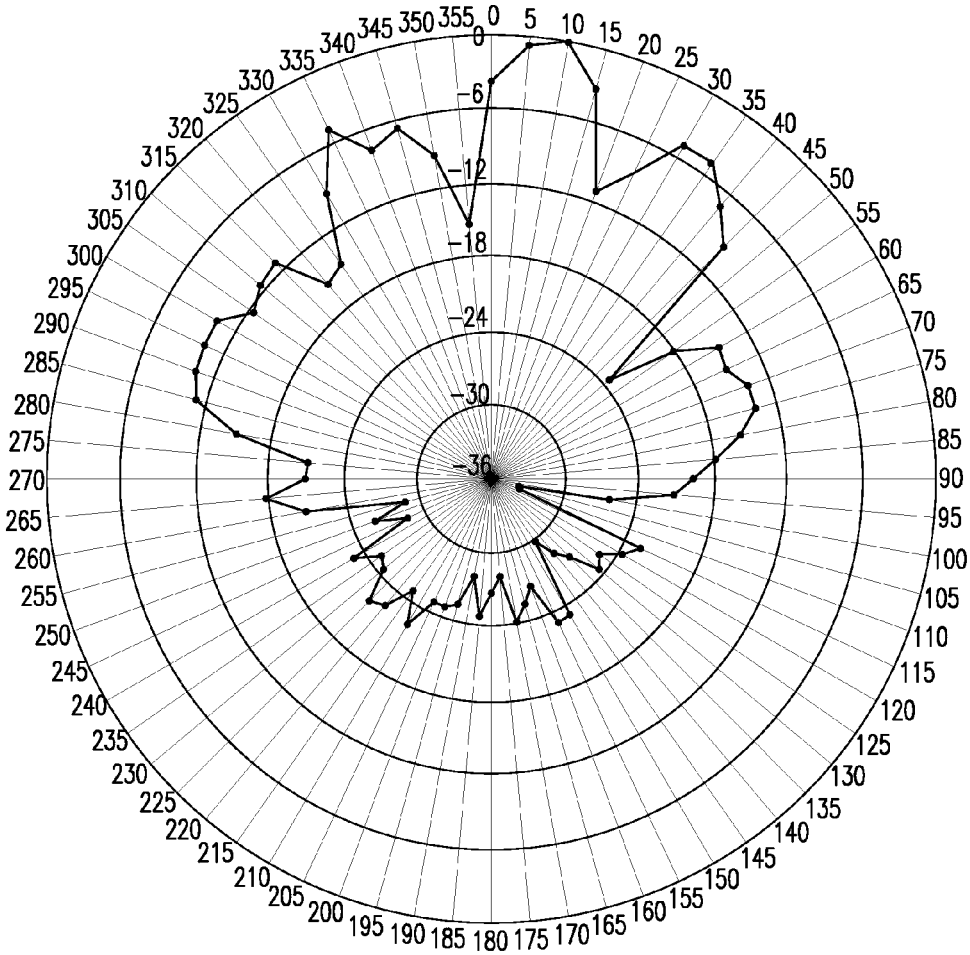
FIG. 6E is a graphic representation of experimentally measured vertical polar response curves at a frequency of 10 kiloHertz for a first embodiment speaker system of the present invention.
Figure 6F:
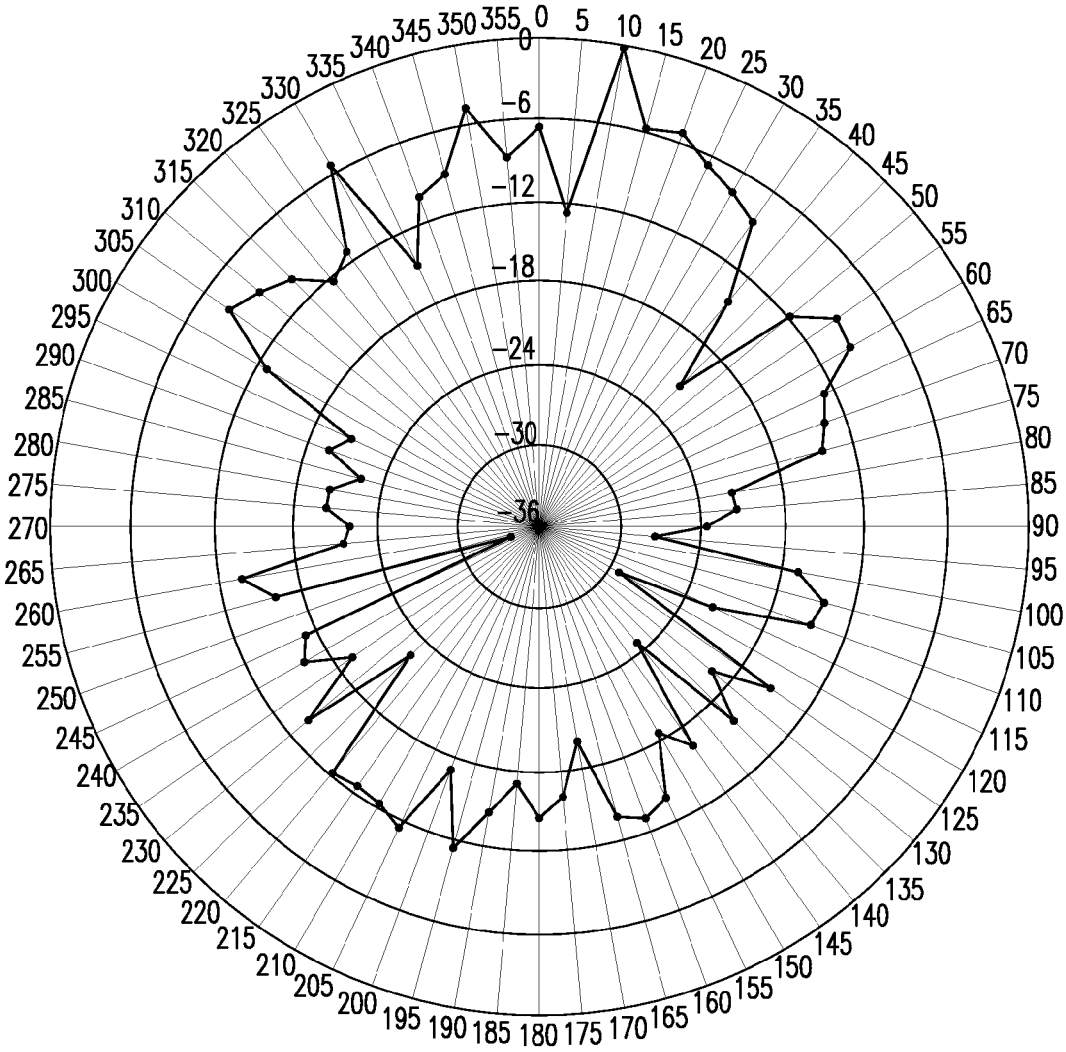
FIG. 6F is a graphic representation of experimentally measured vertical polar response curves at a frequency of 18 kiloHertz for a first embodiment speaker system of the present invention.

FIGS. 5A-5C relate to the typical wall mounted configuration of the speaker system 10. FIG. 5A illustrates a typical speaker enclosure or cavity 30 formed in a wall 32, and FIG. 5B shows the enclosure 30 as occupied by a speaker system 10. As shown in more detail in FIG. 5C, the frame 12 is typically mounted either flush with the wall 32 or such that it protrudes only a slight distance from the wall 32. The horn assembly 16 and any woofer or the like supported by the aperture 28 are received in the cavity 30. The wall 32 defines a wall plane 40, and the mouth(s) 20 of the horn assembly 16 substantially define a mouth plane 42. (While in some embodiments the horn mouth(s) 20 may be imparted a slight convex curve for aesthetic reasons, the mouth(s) 20 are still considered to be substantially planar for practical acoustic purposes.) The wall and mouth planes 40, 42 are typically either coplanar or substantially parallel and spaced a relatively small distance apart.

In operation, the drivers 24 are connected to a signal source, such as an audio amplifier, a tuner, an A/V receiver, or the like, and are energized by a signal from the same. Each driver 24 transduces the signal into an acoustic signal (i.e., modulated pressure waves) that propagates along the connected throat 22 and exits the mouth 20 of the respective horn 18. (In the case of the embodiments of FIGS. 2A-2D, the respective throats 22' are connected to a common mouth 20').

The mouths 20 are positioned sufficiently close to one another such that the separation distance of the mouths 20 is less than or equal to the wavelengths of the sounds produced by the horns 18, such that the horns 18 are mutually coupled when in operation regarding the desired bandwidth of the application. For applications having desired outputs in the 5-10 kHz range, the mouth-to-mouth separation distance is typically less than about 2 inches, more typically less than about 1 inch, still more typically less than about ½ inch, and yet more typically less than about ¼ inch. It is understood that the speaker system 10' embodiment shown in FIGS. 2A-2D may be readily substituted for the speaker system 10 as shown in FIGS. 3A-3D and 4A-4C.

As shown in FIGS. 6A-6F, the polar directivity of the acoustic output of the speaker system 10 is substantially smooth and generally constant over a wide dispersion angle over a broad range of frequencies in a first (horizontal) plane; the polar directivity in a second plane normal to the first plane (vertical) is typically substantially narrower over the same range of frequencies. The data comprising FIGS. 6A-6F was generated experimentally on a vertical speaker stack (such as illustrated in FIG. 3A) via well-known acoustic techniques of rotating the speaker system 10 on a standard baffle in a spherical pattern every 5 degrees to closely approximate an in-wall speaker system.

As can be seen, at a frequency of 5000 Hz, the acoustic dispersion of the speaker system 10 is substantially constant over a 150-degree angle, with the −6 dB down points occurring at about +/−55 degrees from center in the horizontal plane. (See FIG. 6A). At 10,000 Hz in the horizontal plane, the speaker system 10 exhibits a substantially constant acoustic dispersion over about 115 degrees, with −6 dB down points at about +/−50 degrees from center; at 10,000 Hz, the acoustic output does exhibit some lobing formation due to the interference effects of phase summation. (See FIG. 6B). At 18,000 Hz in the horizontal plane, the speaker system 10 exhibits a substantially constant acoustic dispersion over about 130 degrees, with −6 dB down points at about +/−60 degrees from center; at 18,000 Hz, the acoustic output exhibits multiple lobing formation due to the interference effects of the phase summation. (See FIG. 6C).

Likewise, in the vertical plane at a frequency of 5000 Hz, the acoustic dispersion of the speaker system 10 is already tri-lobed (i.e., the dispersion pattern exhibits three distinct major lobes), with the −6 dB down points occurring at about +/−20 degrees from center in the horizontal plane. (See FIG. 6D). At 10,000 Hz in the vertical plane, the speaker system 10 exhibits five lobes and has −6 dB down points in the center lobe at about +/−15 degrees from center. (See FIG. 6E). At 18,000 Hz in the vertical plane, the speaker system 10 exhibits multi-lobed acoustic dispersion that approximates a smooth output over about 120 degrees, with −6 dB down points at about +/−35 degrees from center. (See FIG. 6F).

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A loudspeaker device, comprising in combination:

an enclosure;

a horn assembly positioned in the enclosure and having a first throat defining a first axis and having a first mouth defining a first plane and having a second throat defining a second axis and having a second mouth defining a second plane;

a first driver acoustically connected to the first throat;

a second driver acoustically connected to the second throat;

wherein the first axis substantially perpendicularly intersects the first driver;

wherein the second axis substantially perpendicularly intersects the second driver;

wherein the first and second axes are nonparallel; and wherein the first and second planes are substantially coplanar.

2. The device of claim 1, further comprising:

a wall defining a wall plane; and a recess formed in the wall and sized to receive the enclosure;

wherein the enclosure is received within the recess; and wherein the first, second and wall planes are substantially coplanar.

3. The device of claim 1 further comprising a woofer positioned in the enclosure.

4. The device of claim 3 wherein the first horn, the second throat and the woofer are arranged in a substantially vertical stack and wherein the second throat is positioned between the first horn and the woofer.

5. The device of claim 3 wherein the first throat, the second horn and the woofer are arranged in a substantially horizontal line and wherein the second throat is positioned between the first horn and the woofer.

6. The device of claim 3 wherein the first throat and the second throat are arranged in a substantially horizontal line and wherein the woofer is positioned below the first horn and the second horn.

7. The device of claim 1 further comprising:

a third horn positioned in the enclosure between the first and second horns and having a third throat defining a third axis and having a third mouth defining a third plane; and a third driver acoustically connected to the third horn;

wherein the third plane is substantially coplanar with the first and second planes.

8. The device of claim 7 further comprising at least one woofer positioned in the enclosure.

9. The device of claim 8 wherein the throats are positioned to define a substantially horizontal array and wherein at least one woofer is a plurality of woofers positioned below the array.

10. The device of claim 1 wherein the first and second throats are coextensive.

11. The device of claim 1 wherein the first and second mouths are substantially coextensive.

12. The device of claim 1 wherein the first and second throats are coextensive and wherein the first and second mouths are substantially coextensive.

13. The device of claim 1 wherein the enclosure is a recess formed in a wall.

14. A speaker system, comprising:

a first waveguide further comprising:

a first acoustic driver;

a first mouth defining a first mouth plane; and a first throat operationally connected between the first acoustic driver and the first mouth;

a second waveguide further comprising:

a second acoustic driver;

a second mouth defining a second mouth plane; and a second throat operationally connected between the second acoustic driver and the second mouth;

wherein the speaker system is characterized by an acoustic dispersion angle of about thirty degrees in a first dispersion plane;

wherein the speaker system is characterized by an acoustic dispersion angle of at least ninety degrees in a second dispersion plane oriented orthogonally to the first dispersion plane; and wherein the first and second mouth planes are substantially coplanar.

15. The system of claim 14 wherein the first dispersion plane is substantially horizontal and wherein the second dispersion plane is substantially vertical.

16. The system of claim 14 wherein the first dispersion plane is substantially vertical and wherein the second dispersion plane is substantially horizontal.

* * * * *